US007073744B2

(12) United States Patent
Leitenberger

(10) Patent No.: US 7,073,744 B2
(45) Date of Patent: Jul. 11, 2006

(54) METHOD AND APPARATUS FOR WINDING A MATERIAL WEB

(75) Inventor: Werner Leitenberger, Schlier (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/869,910

(22) Filed: Jun. 18, 2004

(65) Prior Publication Data

US 2004/0238682 A1 Dec. 2, 2004

Related U.S. Application Data

(63) Continuation of application No. PCT/EP02/13034, filed on Nov. 21, 2002.

(30) Foreign Application Priority Data

Dec. 21, 2001 (DE) ..... 101 63 623

(51) Int. Cl.
*B65H 18/14* (2006.01)
*B65H 18/26* (2006.01)

(52) U.S. Cl. ..... 242/541.4; 242/541.5; 242/541.7; 242/542.3

(58) Field of Classification Search ..... 242/541.7, 242/541.4, 541.5, 542.3
See application file for complete search history.

(56) References Cited

U.S. PATENT DOCUMENTS

| | | | | |
|---|---|---|---|---|
| 3,258,217 | A * | 6/1966 | MacArthur et al. | 242/541.7 |
| 4,634,068 | A * | 1/1987 | Malkki et al. | 242/541.7 |
| 4,979,689 | A | 12/1990 | Snygg | |
| 5,154,367 | A * | 10/1992 | Beisswanger | 242/541.4 |
| 5,261,620 | A | 11/1993 | Holzinger et al. | |
| 5,611,500 | A * | 3/1997 | Smith | 242/541.4 |
| 5,645,245 | A | 7/1997 | Kremar | |
| 5,820,065 | A * | 10/1998 | Altosaar et al. | 242/534 |
| 6,036,137 | A * | 3/2000 | Myren | 242/541.7 |
| 6,129,305 | A | 10/2000 | Möller et al. | |
| 6,260,788 | B1 * | 7/2001 | Hultcrantz et al. | 242/533.2 |
| 6,325,323 | B1 * | 12/2001 | Olsson | 242/541.7 |
| 6,390,408 | B1 | 5/2002 | Madrzak et al. | |

FOREIGN PATENT DOCUMENTS

| | | |
|---|---|---|
| DE | 3539980 | 5/1986 |
| DE | 4401804 | 6/1994 |
| DE | 19735590 | 11/1998 |
| DE | 19807897 | 8/1999 |
| DE | 19822261 | 11/1999 |

(Continued)

*Primary Examiner*—Kathy Matecki
*Assistant Examiner*—Sang Kim
(74) *Attorney, Agent, or Firm*—Greenblum & Bernstein, P.L.C.

(57) ABSTRACT

Apparatus for winding a material web includes one of a spool and a reel. A carrier drum forms a winding nip with the spool or the reel. The material web is guided over the carrier drum. Primary arms guide the spool or the reel when the spool or the reel is in a primary winding phase. Pressing levers are arranged on the primary arms. The pressing levers are structured and arranged to press the spool or the reel onto the carrier drum. Secondary arms are structured and arranged to press the spool or the reel onto the carrier drum when the spool or the reel is in a secondary winding phase. The carrier drum is mounted axially between the primary arms. This Abstract is not intended to define the invention disclosed in the specification, nor intended to limit the scope of the invention in any way.

82 Claims, 5 Drawing Sheets

FOREIGN PATENT DOCUMENTS

| | | |
|---|---|---|
| DE | 19848813 | 4/2000 |
| DE | 19944295 | 4/2000 |
| DE | 19852257 | 5/2000 |
| DE | 19923930 | 11/2000 |
| EP | 0350212 | 1/1990 |
| EP | 0561128 | 9/1993 |
| GB | 1600070 | 10/1981 |
| WO | 98/52858 | 11/1998 |

* cited by examiner

METHOD AND APPARATUS FOR WINDING A MATERIAL WEB

CROSS-REFERENCE TO RELATED APPLICATIONS

The instant application is a continuation of International Application No. PCT/EP02/13034 filed on Nov. 21, 2002 and published as International Publication WO 03/053827 on Jul. 3, 2003, the disclosure of which is hereby expressly incorporated by reference hereto in its entirety. The instant application also claims priority under 35 U.S.C. §119 of German Application No. 101 63 623.7 filed on Dec. 21, 2001.

BACKGROUND OF THE INVENTION

1. Field of the Invention

The invention relates to an apparatus for winding a material web, in particular a paper or board web, onto a spool, in which the material web is led over a carrier drum and a winding nip is formed between the spool or the reel to be formed on the latter and the carrier drum. The spool is guided by primary arms in a primary winding phase and is capable of being pressed onto the carrier drum by pressing levers provided on the primary arms. While in a secondary winding phase, it can be pressed onto the carrier drum by secondary arms.

2. Description of the Prior Art

Winding apparatus of this type is disclosed, for example, in documents DE 35 39 980 C2, EP 0 561 128 B1, DE 198 22 261 A1 and WO 98/52858.

The previously common, so-called horizontal winders for standard applications, having a spool guided horizontally in the secondary winding phase and without a center drive in the primary and secondary range, essentially have the following features: A stationary carrier drum is driven at a drive-side journal. The composition of the carrier drum surface depends on the requirements of the various paper grades and winding parameters. For specific uses, rubber-covered carrier drums are used. These have to be removed and reground at time intervals of about 7 to 12 months. The primary arms are mounted, in particular, eccentrically, on the bearing housings of the carrier drum. The line force required for the winding operation between carrier drum and spool is produced in the primary range by the additional pressure which is effected by pressing levers provided on the primary arms and which, in particular, can be actuated by hydraulic cylinders. The line force produced by the inherent weight of the empty spool is normally compensated for by load-relieving cylinders. In the secondary range, the line force is produced by the so-called secondary arms. These arms, in particular, again actuated by means of hydraulic cylinders, accept the spool after it has been deposited on the running rails by the primary arms, and press it against the carrier drum until the maximum roll diameter is reached. In order to produce a high-quality reel, the line force must follow a predefined intended profile over the entire reel build-up, that is to say both in the primary and in the secondary range. The necessary hydraulic pressures in the pressing cylinders of the primary and secondary pressing system and in the load-relieving cylinders are calculated while taking account of the geometry and of the inherent weight components (spool position, force action directions of the pressing levers, inherent weights).

Such a conventional horizontal winder has, inter alia, the disadvantage that, in order to remove the carrier drum, the primary arms have to be separated from all the connections (pivoting cylinders, parallel guide, electrical and hydraulic connections, and so on) and also have to be removed.

In addition, in the case of the conventional horizontal winder, there is a lack of direct line force measurement. The line force actually acting between spool and carrier drum is distorted by frictional forces in the hydraulic cylinders, and in the lever and cylinder pivots. The frictional forces are not constant. They can change over the running time and, moreover, lead to skewed line force profiles. Faults are generally detected only through winding faults. A particularly critical point is the transfer of the spool from the primary to the secondary winding system, in which both pressing systems are effective for a short time. In this case, a line force increase (peak) is unavoidable. This can result in the reel produced in the primary range being damaged by the briefly higher line force. A further distortion of the line force in the secondary range can result from any equipment which may be present for vibration damping (friction brake on the secondary arm). In this case, it has already been proposed to incorporate force measuring pins in the pressure rollers of the secondary arms, with which the pressing forces on the secondary arm can be measured directly. However, because of the pressing geometry which changes over the winding profile, it is necessary for the measured signal to be converted as a function of the position of the primary arms. At least for the profile of the line force in the primary range, this proposal does not provide any advantages.

SUMMARY OF THE INVENTION

The invention provides an improved winding apparatus of the type mentioned at the beginning which, in order to achieve an optimum line force profile, in particular, also permits direct and sensitive line force measurement on the carrier drum. By way of corresponding active monitoring of the pressing elements, corresponding diagnosis is, in particular, also possible. The mounting of the winding apparatus, and a respective carrier drum change, are possible with minimum expenditure of time. Both for the preassembly and also for the transport and the final mounting, the possibilities for optimized logistics are provided. In addition, improved web guidance is achieved in order to implement the required entry web tension with the lowest possible line forces. Moreover, the installation of an oscillating device is made possible.

According to the invention, the carrier drum is mounted axially within and independently of the primary arms.

In this case, the carrier drum can be coupled to the associated drive, preferably in the region of a drive-side carrier drum journal, axially within the primary arm mounting. For example, a drive flange can be provided on the carrier drum journal axially within the primary arm mounting. After the flange of the drive shaft has been removed, the carrier drum with its bearings can be lifted freely out of the winding apparatus without further parts having to be removed in the process.

It is also advantageous if at least one bearing bracket, provided on the drive side and assigned to the relevant primary arm, is provided with an opening for a drive shaft.

According to a preferred practical embodiment of the apparatus according to the invention, a measuring device is provided, in particular, in the region of the carrier drum bearing, for measuring the line forces acting on the carrier drum. In this case, the measuring device is preferably provided on the carrier drum bearing.

An attachment of the carrier drum bearing having a degree of freedom preferably in the "x" or generally horizontal direction is expediently provided. By way of the measuring device, the components of the line forces which result in the relevant direction, that is to say, in particular, in the "x" or generally horizontal direction, can preferably then be measured.

It is therefore possible, for example, to provide an attachment of the carrier drum bearing preferably with a degree of freedom in the "x" or generally horizontal direction. The independent mounting of the carrier drum provides the possibility of directly measuring the line forces (for example x component) acting on the carrier drum, by way of the installation of a force measuring system, for example. The friction, for example, in hydraulic cylinders and in the pivots of the pressing elements, can be ruled out as an error variable for the line force.

The measuring device can, for example, be combined with a positioning device, by which the carrier drum can be set obliquely with respect to the running direction of the material web fed in. This can be done in order to produce an axial oscillation of the material web in the reel produced. The measuring device can therefore, for example, be combined with a hydraulic cylinder for the single-sided displacement of the carrier drum (oscillation).

The material web can preferably be fed to the carrier drum in a direction which is at substantially right angles to the direction corresponding to the degree of freedom of the carrier drum bearing attachment. In this case, the material web can preferably be fed to the carrier drum in the generally vertical direction. In the latter case, therefore, no "x" component occurs, so that, if the carrier drum bearing is attached with a degree of freedom in this "x" or generally horizontal direction, the line force measurement is not affected.

The mounting of a doctor on the base of the carrier drum bearing is possible. Because of the missing "x" component, the line force measurement is not affected.

Upstream of the carrier drum in the web running direction, the material web can be led over a spreader roll. Preferably it can be led over what is known as a Lüraflex® spreader roll. Such a Lüraflex® spreader roll is ideal, in particular, in the event of vertical web guidance to the carrier drum. As a result, compared with a spreader roll with a curve, a greater wrap is possible. A guide roll which is otherwise additionally required is therefore saved.

Moreover, the Lüraflex® spreader roll can be used at the same time for web tension measurement, which is not possible in the case of a conventional spreader roll with a curve.

In addition, a cylindrical roll barrel is associated with optimum web guidance after a measuring appliance or a measuring device (flat position of the web through the measuring head of the scanner).

It is also advantageous if the carrier drum loose bearings are CARB bearings, which are associated with minimum axial forces.

In the secondary winding phase, the spool is preferably guided horizontally.

A control and/or evaluation device is expediently provided, with which, for example, the pressing elements and so on can be driven and/or regulated appropriately.

In a preferred practical embodiment of the apparatus according to the invention, a respective new spool, that is to say a respective empty spool, can have winding started in a position in which the angle between a straight line running through the axes of the spool and of the carrier drum and the vertical lies in a region of approximately 20°.

In the primary winding phase, indirect line force control can, in particular, be carried out. This can occur, preferably, with pressure predefinition (reference predefinition for hydraulic cylinders).

The spool can expediently be pivoted down onto preferably horizontal running rails, on which it is guided during the secondary winding phase. As the spool is pivoted down, the line force can preferably be controlled and/or regulated in such a way that the result is a transition from indirect line force control to direct line force control.

The primary pressing elements can be controllable as a function of the measured values supplied by the measuring device.

A preferred practical embodiment of the apparatus according to the invention is distinguished by the fact that a system/arrangement is provided for monitoring the primary pressing elements and, by way of the control and/or evaluation device, corresponding fault diagnosis can be carried out.

Advantageously, at the transition from the primary winding phase to the secondary winding phase, the primary pressure can be reduced in accordance with the increase in the secondary pressure. In this way, the result in this transition phase is an at least substantially constant line force profile.

Direct line force control is preferably carried out in the secondary winding phase.

An expedient practical embodiment is distinguished by the fact that a system/arrangement is provided for monitoring the secondary pressing elements and, by way of the control and/or evaluation device, corresponding fault diagnosis can be carried out.

It is also advantageous if, before a respective new spool is placed on the carrier drum, the current hydraulic pressure in the secondary pressing system, which can be predefined by the measuring device, can be frozen.

At the end of the winding operation, the line force can advantageously be controlled and/or regulated in such a way that the result is a transition from direct line force control to indirect line force control.

The control and/or evaluation device is preferably designed in such a way that, after the full spool has been ejected, a new control cycle begins.

It is therefore possible, for example, for the following control concept to be implemented: Winding is started (new spool in the primary arm, no spool in the secondary area). In the start winding position (for example at an angle of approximately 20° with respect to the vertical), the horizontal line force component on the carrier drum is only about 34%, it being possible for the torque for driving the spool to affect the measurement. It is therefore possible in particular for indirect line force control with pressure predefinition in the primary pressing system to be carried out. The spool is pivoted down onto the running rails which, for example, are horizontal. The horizontal line force component increases to 100%. The drive component decreases to zero. Accordingly, there is a transition to direct line force control. The transition takes place without a line force step. The hydraulic pressure in the primary pressing system can already be influenced on the way to the running rails by the measured result on the carrier drum. In a corresponding way, for example, fault diagnosis by way of active monitoring of the primary pressing elements is possible. The transfer from the primary to the secondary pressing system then takes place. The secondary arms are applied at a lower speed. In the event of a rise in pressure on the measuring device, the pressure in the primary pressing system is reduced in accordance with the increase in the secondary pressing system, so that the line force profile remains as constant as possible. Direct line force control is then carried out. Fault diagnosis can be carried out by way of active monitoring of the secondary pressing elements. Finally, what is known as a reel change is carried out. Before the placement of the new spool on the carrier drum, the hydraulic pressure in the secondary pressing system, currently predefined by the measuring device, is "frozen". There is a transition from direct to indirect line force control. After the full spool has been ejected, the new control cycle then begins (pivoting down to the running rail and so on).

The winding apparatus according to the invention permits, inter alia, an optimal reel build-up by way of precise line force control, after the line force generation and the line force measurement have been decoupled from each other. The friction in the hydraulic cylinders and in the pivots of the pressing elements can be ruled out as an error variable with respect to the line force. Influences arising from the web tension and the doctor pressure are avoided by the vertical web guidance and by the attachment of the doctor to the base of the carrier drum mounting. Even the frictional forces of a vibration damper brake which may possibly be provided in the secondary range have no influence on the line force. The transfer from the primary to the secondary winding system can be implemented with the least possible increase in line force. There is a possibility of fault diagnosis by way of active monitoring of the pressing elements. The hydraulic pressures in the pressing cylinders must be in a specific relation with the measured value on the carrier drum. Deviations are not just detected when winding faults occur.

Furthermore, a fast carrier drum change is possible. In order to remove the carrier drum, only the drive coupling and the bearing fixing have to be released. The entire primary range remains untouched. This is an important aspect in the case of rubber-covered carrier drums, which have to be changed regularly, for example, every 7 to 12 months. Moreover, logistical advantages result in the pre-assembly and/or pre-piping, transport and final mounting. For transport, it is merely necessary for carrier drum, doctor and crossmember to be dismantled and for the transverse piping to be separated.

In addition, a greater web wrap on the carrier drum is possible. The web tension upstream of the carrier drum has a significant influence on the winding hardness. With the greater wrap, the necessary web tension can be implemented with a lower line force. This is particularly important for pressure-sensitive papers. In the following text, an example is to be given with which the aforementioned advantages are illustrated:

Previous concept: Wrap 55° (start winding) 125° (operation);

Proposed concept: e.g. 110°; e.g. 180°

Friction carrier drum/paper: $\mu 0.3$;

Web tension before the carrier drum: 700 N/m;

Required line force:

previous concept is 100% proposed concept≈75%.

Otherwise, the winding apparatus can be designed, at least substantially, in the same way as the conventional winding apparatus mentioned at the beginning.

The invention also provides for an apparatus for winding a material web, wherein the apparatus comprises one of a spool and a reel, a carrier drum forming a winding nip with the spool or the reel, wherein the material web is guided over the carrier drum, primary arms guiding the spool or the reel when the spool or the reel is in a primary winding phase, pressing levers arranged on the primary arms, wherein the pressing levers are structured and arranged to press the spool or the reel onto the carrier drum, and secondary arms structured and arranged to press the spool or the reel onto the carrier drum when the spool or the reel is in a secondary winding phase, wherein the carrier drum is mounted axially between the primary arms, and wherein the primary arms are independent of the carrier drum.

The material web may be one of a paper web, a board web and a cardboard web. The primary arms may be independent of the carrier drum. The primary arms and the carrier drum may move independently from one another. The carrier drum may be adapted to be coupled to an associated drive in a region of a drive-side carrier drum journal. The carrier drum may be coupled to an associated drive in a region of a drive-side carrier drum journal. The drive-side drum journal may be axially arranged between the carrier drum and a the primary arm mounting. The primary arms may movably guide the spool or the reel during the primary winding phase. The primary arms may pivot about an axis which substantially parallel to an axis of the carrier drum. The primary arms may comprise first and second primary arms which are mounted via first and second primary arm mountings to first and second supports. The carrier drum may be mounted to the first and second supports via first and second carrier drum mountings. A first end of the carrier drum may be spaced from the first primary arm and a second end of the carrier drum may be spaced from the second primary arm. The first carrier drum mounting may be spaced from the first primary arm and the second carrier drum mounting may be spaced from the second primary arm.

The carrier drum may be coupled to an associated drive in a region of a drive-side carrier drum journal, and wherein the apparatus further comprises a drive flange coupled to the drive-side carrier drum journal. The drive flange may be axially arranged between one end of the carrier drum and a primary arm mounting of one of the primary arms.

The apparatus may further comprise at least one bearing bracket arranged on drive side of the apparatus, wherein the at least one bearing bracket is coupled to one of the primary arms. The at least one bearing bracket may comprise an opening for a drive shaft.

The apparatus may further comprise a measuring device. The measuring device may be arranged in a region of a carrier drum bearing. The measuring device may be structured and arranged to measure line forces acting on the carrier drum. The measuring device may be arranged on a carrier drum bearing. The measuring device may be coupled to a carrier drum bearing.

The apparatus may further comprise at least one carrier drum bearing. The at least one carrier drum bearing may be movably mounted. The at least one carrier drum bearing may be movable along at least one of a linear direction and a generally horizontal direction. The at least one carrier drum bearing may be movable along a direction that is substantially perpendicular to an axis running through the carrier drum.

The apparatus may further comprise two carrier drum bearings which are movable along a direction that is substantially perpendicular to an axis running through the carrier drum.

The apparatus may further comprise two carrier drum bearings supporting the carrier drum, wherein the carrier drum is rotatably mounted to the two carrier drum bearings, wherein the two carrier drum bearings are movable along a direction that is substantially perpendicular to an axis running through the carrier drum, and wherein two carrier drum bearings are mounted between the primary arms.

The apparatus may further comprise two carrier drum supports, wherein the carrier drum is rotatably mounted to the two carrier drum supports, wherein the two carrier drum supports are movable along a direction that is substantially perpendicular to an axis running through the carrier drum, and wherein two carrier drum supports are arranged between the primary arms.

The apparatus may further comprise a measuring device structured and arranged to measure line forces along a direction. The direction may comprise a generally horizontal direction.

The apparatus may further comprise a measuring device and a positioning device. The carrier drum may be structured and arranged to produce an axial oscillation of the material web.

The apparatus may be structured and arranged to produce an axial oscillation of the material web on the spool or the reel. The carrier drum may be linearly movably mounted to bearing supports and wherein the apparatus is structured and arranged to allow the material web to be fed to the carrier drum in a direction which is substantially perpendicular to a linear movement direction of the carrier drum. The apparatus may be structured and arranged to feed the material web from a vertical direction to the carrier drum. The carrier drum may be mounted to at least one carrier drum bearing and further comprising a doctor mounting arranged on a base of the at least one carrier drum bearing.

The apparatus may further comprise a spreader roll arranged upstream of the carrier drum in a web running direction, whereby the material web is guided over the spreader roll. The spreader roll may comprise a Lüraflex® spreader roll. The spreader roll may participate in web tension measurement. The carrier drum may be mounted to CARB bearings. The apparatus may be structured and arranged to guide the spool or the reel horizontally in the secondary winding phase.

The apparatus may further comprise at least one of a control device, an evaluation device, and a control/evaluation device. The apparatus may be structured and arranged to start winding of the spool or the reel at an angled position relative to a vertical line running through an axis of the carrier drum. The angled position may comprise an angle of approximately 20°. In the primary winding phase, the apparatus may be structured and arranged to perform indirect line force control. In the primary winding phase, the apparatus may be structured and arranged to perform indirect line force control with pressure predefinition. The primary arms may pivot about an axis and guide the spool or the reel to a position wherein the spool or the reel can be wound in the secondary winding phase. The primary arms may pivot about an axis and guide the spool or the reel to a horizontal position wherein the spool or the reel can be wound in the secondary winding phase. The primary arms may pivot about an axis and guide the spool or the reel onto horizontal rails wherein the spool or the reel can be wound in the secondary winding phase. The apparatus may be structured and arranged to control a line force while guiding the spool and the reel.

The apparatus may be structured and arranged to control a line force while guiding the spool and the reel. The line force may be indirectly controlled when the spool or the reel is in one position and directly controlled when the spool or the reel is in another position. The line force may be indirectly controlled when the spool or the reel is in the primary winding phase and directly controlled when the spool or the reel is in the secondary winding phase.

The apparatus may further comprise primary pressing elements adapted to be driven based on measured values of a measuring device.

The apparatus may further comprise primary pressing elements coupled to the pressing levers, wherein the primary pressing elements are moved based on measured values of a measuring device.

The apparatus may further comprise primary pressing elements moving the pressing levers, wherein the primary pressing elements move the pressing levers based on measured values of a measuring device.

The apparatus may further comprise a device for monitoring primary pressing elements coupled to the pressing levers. The apparatus may further comprise one of a control device and an evaluation device for conducting a fault diagnosis.

The spool or the reel may be structured and arranged to move from the primary winding phase to a transition phase and then to the secondary transition phase. The apparatus may be structured and arranged to provide at least a substantially constant line force profile in the transition phase. The pressing levers may be structured and arranged to press the spool or the reel against the carrier drum so as to provide at least a substantially constant line force profile in the transition phase.

The apparatus may be structured and arranged to provide direct line force control in the secondary winding phase.

The apparatus may further comprise a device for monitoring secondary pressing elements. The secondary pressing elements may be coupled to the secondary arms. The secondary pressing elements may move the secondary arms and press the spool or the reel against the carrier drum in the secondary winding phase.

The apparatus may further comprise one of a control device and an evaluation device for conducting a fault diagnosis.

The apparatus may be structured and arranged to receive a new spool. The apparatus may be structured and arranged to maintain a substantially constant hydraulic pressure in a secondary pressing system based a measuring device and before the new spool is received on the apparatus. The apparatus may be structured and arranged to at least one of control and regulate a line force. The apparatus may be structured and arranged to transition from direct line force control to indirect line force control.

The apparatus may further comprise one of a control device and an evaluation device structured and arranged to begin a new control cycle after a full spool has been ejected from the apparatus.

The invention also provides for an apparatus for winding a material web, wherein the apparatus comprises a carrier drum configured to form a winding nip with a spool, the carrier drum being rotatably mounted to first and second mounting devices, first and second primary arms configured to move the spool over the carrier drum from a primary winding position to a secondary winding position, first and second pressing levers respectively pivotally mounted to the first and second primary arms, the first and second pressing levers being structured and arranged to press the spool against the carrier drum, and secondary arms structured and arranged to press the spool against the carrier drum when the spool is in a secondary winding position, wherein the carrier drum is mounted between the first and second primary arms.

The apparatus may further comprise a force measuring device configured to detect a force applied to the carrier drum by the spool in at least one of the primary and secondary winding positions. The first and second mounting devices may be movable along at least one of a linear direction and a horizontal direction. The apparatus may further comprising a measuring device configured to detect a force applied to the carrier drum by the spool in at least one of the primary and secondary winding positions.

The invention also provides for a method of winding a material web, wherein the method comprises placing a spool into a primary winding position of an apparatus comprising a carrier drum arranged between first and secondary primary arms, wherein the carrier drum is configured to form a winding nip with the spool, rotating the carrier drum and the spool to wind the spool in the primary winding position, pressing the spool against the carrier drum in the primary winding position with first and second pressing levers respectively pivotally mounted to the first and second primary arms, moving the spool with first and second primary arms over the carrier drum from the primary winding position to a secondary winding position, pressing the spool against the carrier drum when the spool is in the secondary winding position, and moving the spool away from the secondary winding position after the spool is fully wound.

The method may further comprise measuring a force applied to the carrier drum in at least one of the primary and secondary winding positions. The method may further comprise moving the carrier drum along at least one of a linear direction and a horizontal direction. The method may further comprise moving the carrier drum along at least one of a linear direction and a horizontal direction while the spool is in the primary winding position. The method may further comprise moving the carrier drum along at least one of a linear direction and a horizontal direction while the spool is in the secondary winding position. The method may further comprise controlling a line force between the carrier drum and the spool while the spool is in the primary winding position. The method may further comprise controlling a line force between the carrier drum and the spool while the spool is in the secondary winding position. The method may further comprise detecting with a measuring device a force applied to the carrier drum by the spool in at least one of the primary and secondary winding position.

BRIEF DESCRIPTION OF THE DRAWINGS

The invention will be explained in more detail in the following text using exemplary embodiments and with reference to the drawings, wherein.

DETAILED DESCRIPTION OF THE PRESENT INVENTION

Figure 2:
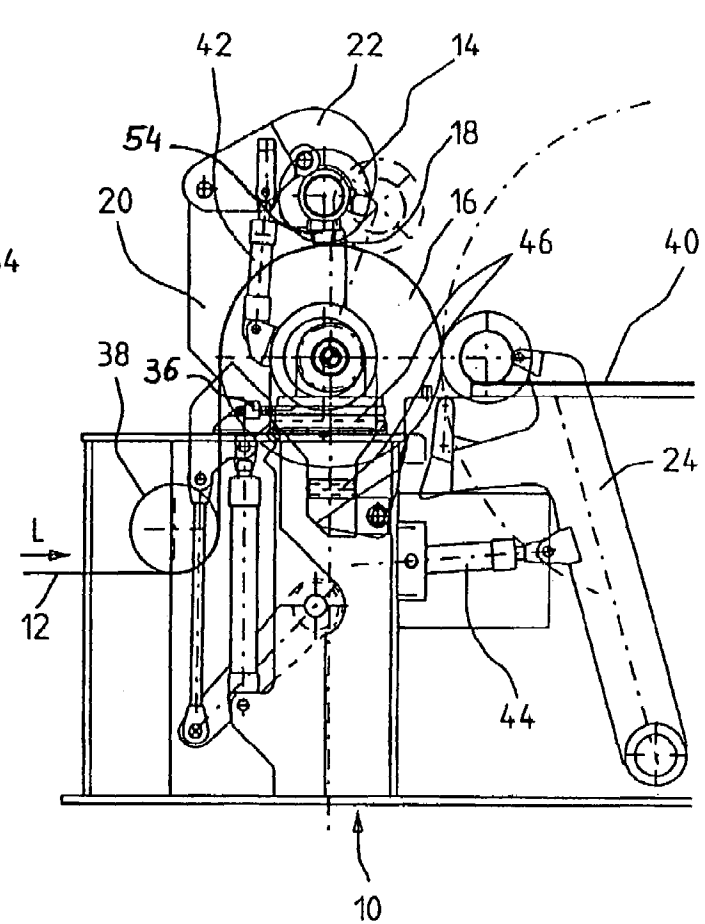
FIG. 2 shows a schematic front view of the winding apparatus shown in FIG. 1.
Figure 1:
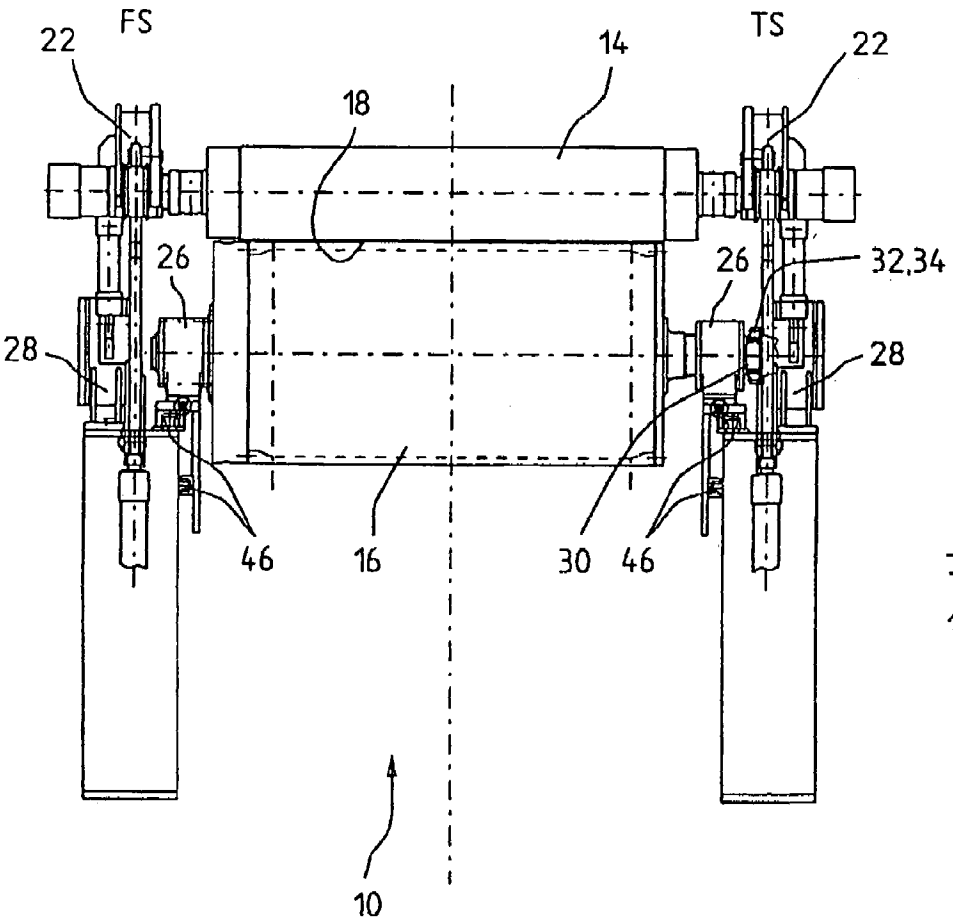
FIG. 1 shows a schematic, partly sectioned illustration of a winding apparatus with a linear guide.

FIGS. 1 and 2 show, in a schematic illustration, a first exemplary embodiment of an apparatus 10 for winding a material web 12 onto a spool or core 14. The material web 12 can be, in particular, a paper or board web. The winding apparatus 10 can therefore be used, for example, for winding paper which comes from a papermaking machine, a coating machine, a supercalender or a printing press.

The material web 12 is led over a carrier drum 16, which forms a winding nip 18 with the spool 14 or with the reel to be formed on the latter.

In a primary winding phase, the spool 14 is guided by primary arms 20 and can be pressed onto the carrier drum 16 by pressing levers 22 provided on the primary arms 20. In a secondary winding phase, the spool 14 or the reel to be formed on the latter is then pressed onto the carrier drum 16 by secondary arms 24. In a transition phase, the spool 14 is therefore transferred from the primary arms 20 to the secondary arms 24.

As can best be seen by using FIG. 1, the carrier drum 16 is mounted axially within and independently of the primary arms 20. The carrier drum mounting 26 is therefore provided axially within the primary arm mounting 28 and designed separately from the latter.

In the region of a drive-side carrier drum journal 30 axially within the primary arm mounting 28, the carrier drum 16 can be coupled to an associated drive. In FIG. 1, the drive side is designated "TS" and the operator side "FS". The relevant drive coupling 32 can, for example, comprise a drive flange 34 arranged axially within the primary arm mounting 28.

At least the bearing bracket provided on the drive side TS and assigned to the relevant primary arm 20 can be provided with an opening. For example, the bearing bracket provided on the drive side TS can be provided with an opening for the relevant drive shaft.

In the region of or on the carrier drum bearing 26, a measuring device 36 can be provided, in particular, a force measuring device, for measuring the line forces acting on the carrier drum 16. The attachment of the carrier drum bearing 26 is provided with a degree of freedom preferably in the "x" or generally horizontal direction. By way of the measuring device 36, the components of the line forces which result in the relevant direction, here preferably the "x" or horizontal direction, can therefore be measured.

The measuring device 36 can, for example, be combined with a positioning device, via which the carrier drum 16 can be set obliquely with respect to the running direction L of the material web 12 fed in, in order to produce an axial oscillation of the material web 12 in the reel being produced.

Figure 8:
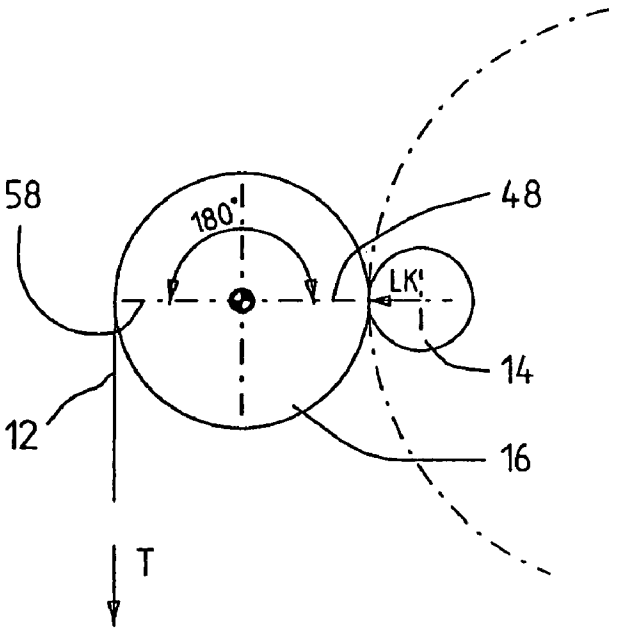
FIG. 8 shows a schematic illustration of the carrier drum and of the spool on which winding has already started and which is assuming its operating position.
Figure 7:
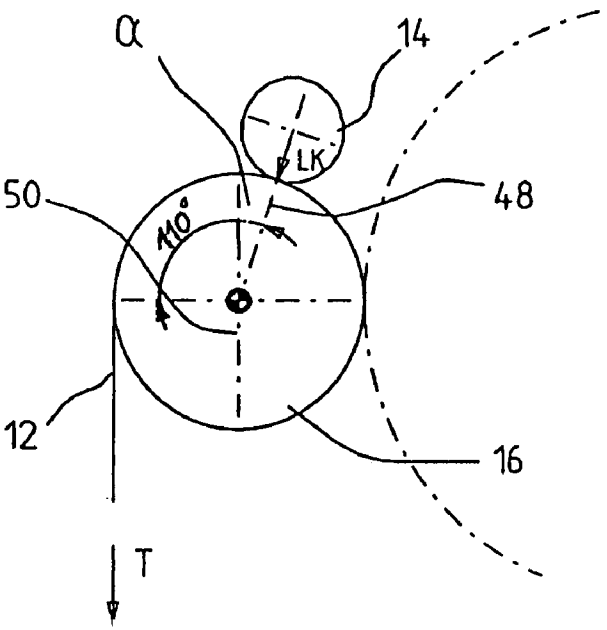
FIG. 7 shows a schematic illustration of the carrier drum and of a spool assuming a start winding position.

As can also be seen, in particular, in FIGS. 7 and 8, the material web 12 is fed to the carrier drum 16 in the generally vertical direction in the present case. The material web 12 is therefore fed in a direction which is at substantially right angles to the direction corresponding to the degree of freedom of the carrier drum bearing attachment, here in the "x" or generally horizontal direction.

A doctor mounting can be provided on the base of the carrier drum bearing 26.

As can be seen, in particular, in FIG. 2, upstream of the carrier drum 16 in the web running direction L, the material web 12 is led around a spreader roll 38, which is preferably a Lüraflex® spreader roll. This roll 38, preferably formed by a Lüraflex® spreader roll, can be provided at the same time for web tension measurement.

The carrier drum loose bearings provided can, in particular, be CARB bearings.

The spool 14 is pivoted down onto horizontal running rails 40 by the primary arms 20. In the secondary winding phase, the spool 14 is therefore guided horizontally.

The pressing levers 22 can be acted on by pressing elements 42, and the secondary arms 24 can be acted on by pressing elements 44.

The line force produced by the inherent weight of the empty spool can be compensated for by load-relieving cylinders 54.

Figure 9:
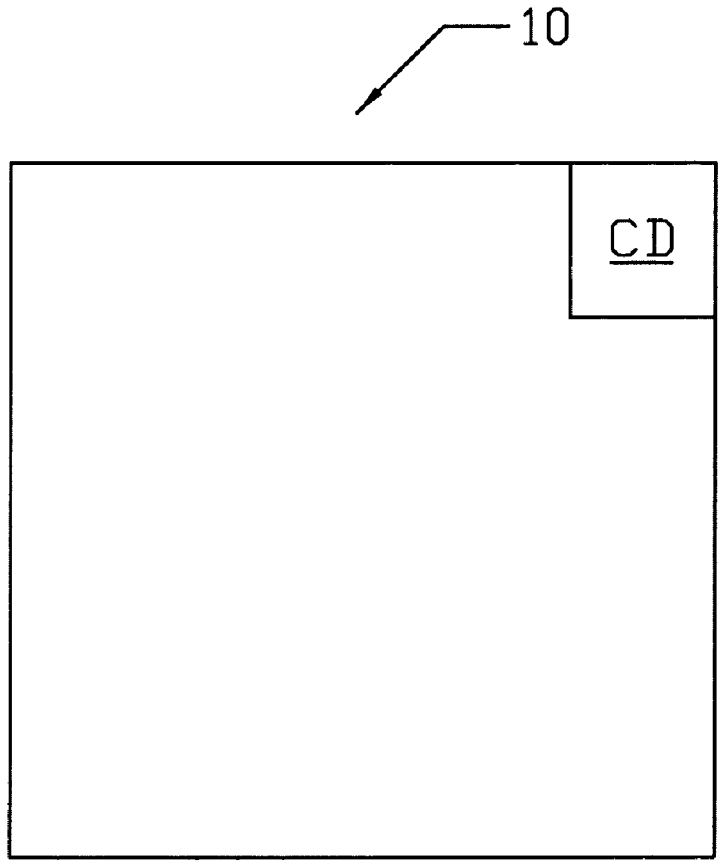
FIG. 9 schematically shows the apparatus with a control and/or evaluation device.

The winding apparatus 10 comprises a control and/or evaluation device CD see FIG. 9), via which, inter alia, the pressing elements 42, 44 can be driven and to which the measuring device 36 is connected.

In the present embodiment, linear guides 46 are provided in order to implement the previously mentioned degree of freedom of the carrier drum bearing attachment in the "x" or generally horizontal direction. Accordingly, the components of the line forces which occur in the winding nip in the "x" or horizontal direction are measured by the measuring device 36.

In the case of the present winding apparatus 10, for example the following control procedure can be implemented: Winding of the new spool 14 is started and is accommodated in the primary arms 20 (no spool in the secondary range). In the start winding position of the spool 14 (see also FIG. 7), in which the angle α between the straight line 48 running through the axes of the spool 14 and of the carrier drum 16 and the vertical 50 lies in a region of about 20°, the horizontal line force component on the carrier drum 16 corresponds to only about 34%. The torque for the drive of the spool 14 affects the measurement. In the primary winding phase and, respectively, during the primary pressing, indirect line force control with pressure predefinition is therefore carried out. The spool 14 is pivoted down onto the running rails 40 by the primary arms 20. In the process, the horizontal line force component rises to 100% and the drive components fall to zero. There is therefore a transition to direct line force control. The transition takes place without a line force step. The hydraulic pressure in the primary pressing system can already be influenced by the measured result on the carrier drum 16 on the way to the running rails 40. Fault diagnosis by way of active monitoring of the primary pressing elements 42 is possible. Transfer then occurs from the primary winding phase and, respectively, the primary pressing to the secondary winding phase and, respectively, the secondary pressing. The secondary arms 24 are applied at low speed to the spool 14 on which winding has already started. In the event of a rise in force determined by the measuring device 36, the pressure in the primary pressing system is reduced by way of the control and/or evaluation device in accordance with the increase in the secondary pressure, so that the line force profile remains as constant as possible. Direct line force control is therefore now carried out. Fault diagnosis is now possible by way of active monitoring of the secondary pressing elements 44. Reel change can then occur. Before a new spool 14 is placed on the carrier drum 16, the hydraulic pressure in the secondary pressing system, currently predefined by the measuring device 36, is "frozen". It is now possible for a transition from direct to indirect line force control to take place. After the full spool has been ejected, the new control cycle (pivoting down onto the running rails 40 and so on) can then begin.

Figure 4:
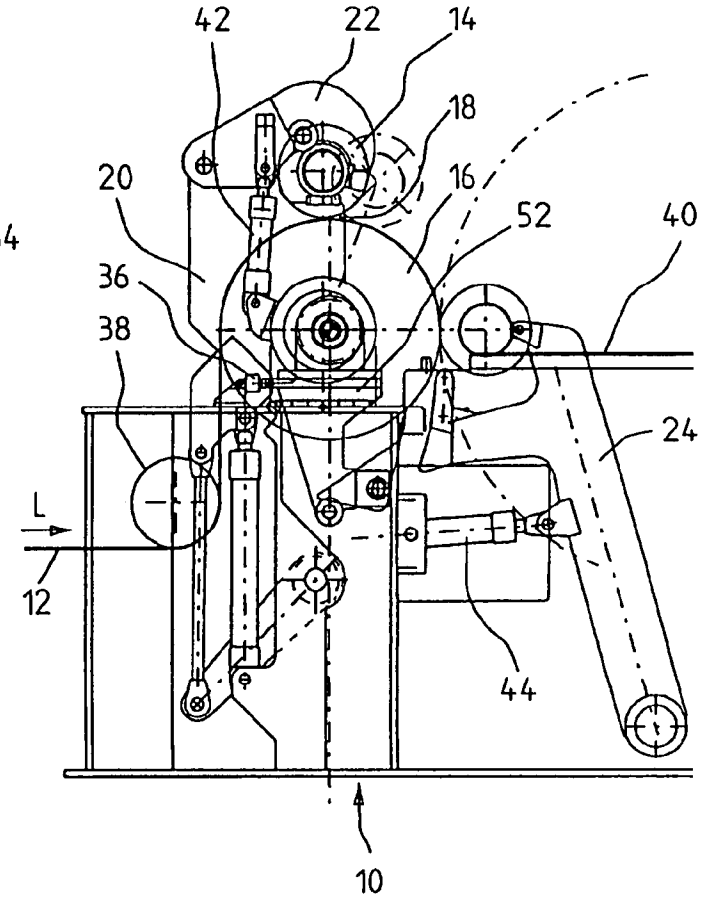
FIG. 4 shows a schematic front view of the winding apparatus shown in FIG. 3.
Figure 3:
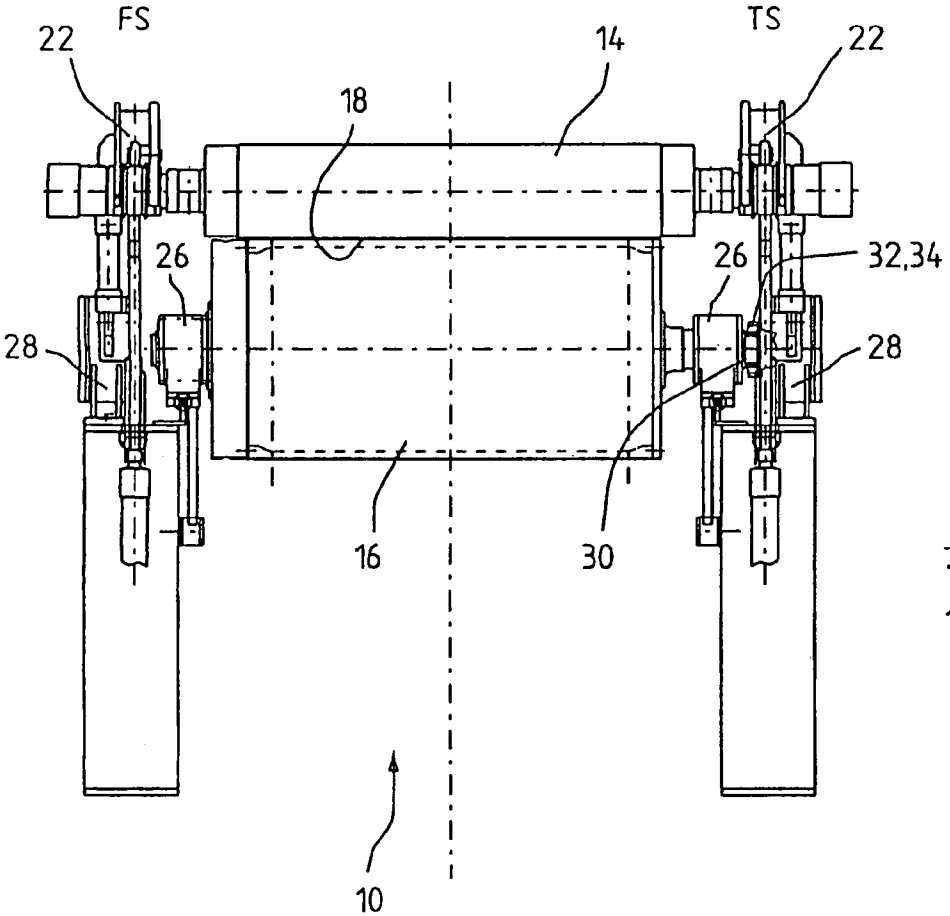
FIG. 3 shows a schematic, partly sectioned illustration of a further embodiment of the winding apparatus with a lever mounting.

FIGS. 3 and 4 show, in a schematic, partly sectioned illustration, a further embodiment of the winding apparatus 10, in which a lever mounting comprising a bearing lever 52 is provided instead of the linear guides.

Otherwise, this embodiment can have, for example, at least substantially, for example the same structure again as that in FIGS. 1 and 2. Mutually corresponding parts are provided with the same reference symbols.

Figure 6:
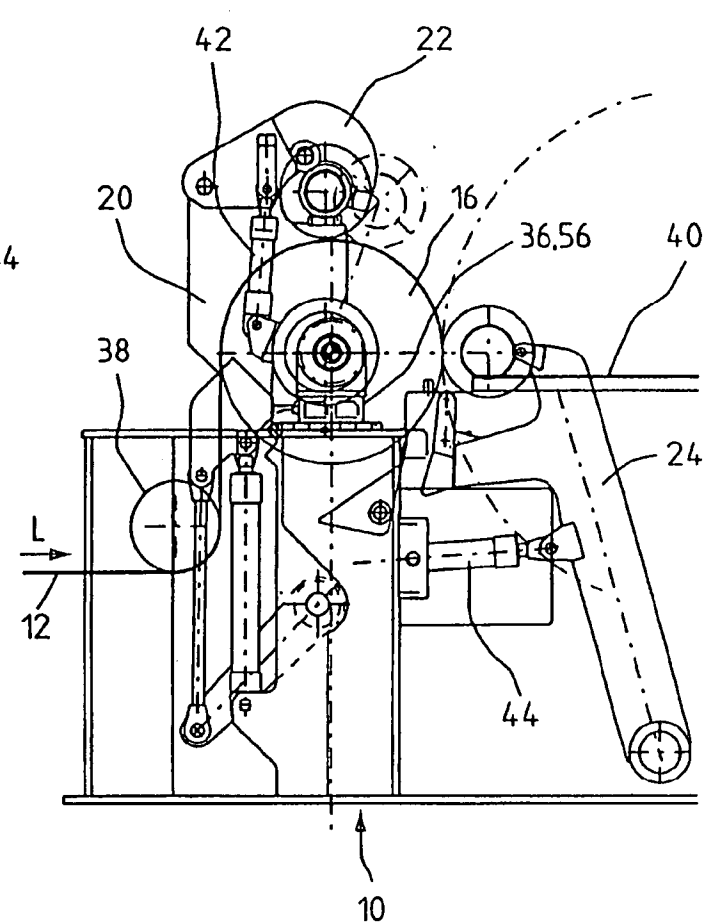
FIG. 6 shows a schematic front view of the winding apparatus shown in FIG. 5.
Figure 5:
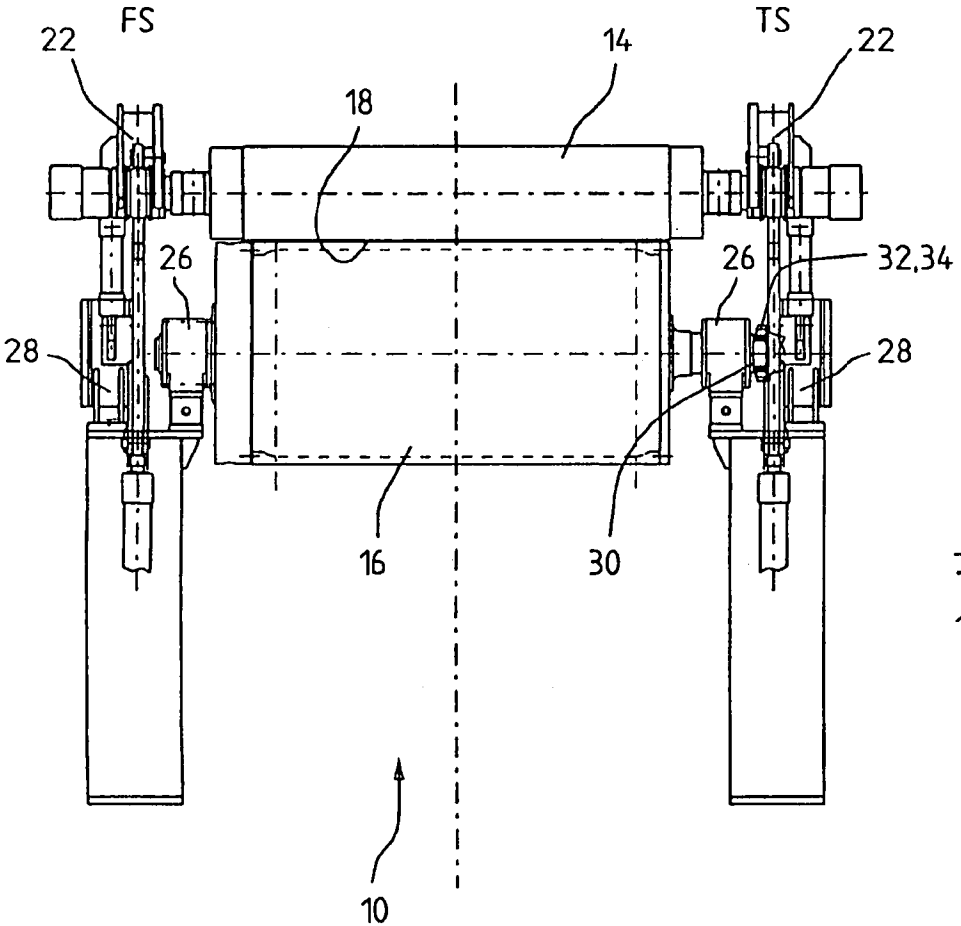
FIG. 5 shows a schematic, partly sectioned illustration of a further embodiment of the winding apparatus with a mounting directly on a measuring box.

FIGS. 5 and 6 show, in a schematic, partly sectioned illustration, a further embodiment of the winding apparatus 10, in which the measuring device 36 comprises at least one force measuring box 56 and the carrier drum 16 is mounted directly on this force measuring box 56.

Otherwise, this embodiment can also have, at least substantially, the same structure again as that in FIG. 1. Mutually corresponding parts are assigned the same reference symbols.

FIG. 7 shows a schematic illustration of the carrier drum 16 and a spool 14 assuming a start winding position.

According to this figure, a respective new spool 14 can have winding started, for example, in a position in which the angle α between the straight line 48 running through the axes of the spool 14 and of the carrier drum 16 and the vertical 50 lies in a region of about 20°.

FIG. 8 shows a schematic illustration of the carrier drum 16 and the spool 14 on which winding has already started and which is assuming its operating position. The axes of the carrier drum 16 and of the spool 14 lie jointly on a horizontal straight line 58.

By using the two FIGS. 7 and 8, it is also possible to see once more that the material web 12 subjected to the tension T is fed to the carrier drum 16 in the vertical direction.

LIST OF REFERENCE SYMBOLS

10 Winding apparatus
12 Material web
14 Spool
16 Carrier drum
18 Winding nip
20 Primary arm
22 Pressing lever
24 Secondary arm
26 Carrier drum mounting
28 Primary arm mounting
30 Drive-side carrier drum journal
32 Drive coupling
34 Drive flange
36 Measuring device
38 Spreader roll, Lüraflex® spreader roll
40 Running rail
42 Pressing element
44 Pressing element
46 Linear guides
48 Straight line
50 Vertical
52 Bearing lever
54 Load-relieving cylinder
56 Force measuring box
58 Straight line
FS Operator side
L Web running direction
TS Drive side
α Angle

What is claimed is:

1. An apparatus for winding a material web, the apparatus comprising:

one of a spool and a reel;

a carrier drum forming a winding nip with the spool or the reel, wherein the material web is guided over the carrier drum;

primary arms guiding the spool or the reel when the spool or the reel is in a primary winding phase;

pressing levers pivotally mounted to the primary arms, wherein the pressing levers are structured and arranged to press the spool or the reel onto the carrier drum; and secondary arms structured and arranged to press the spool or the reel onto the carrier drum when the spool or the reel is in a secondary winding phase, wherein the carrier drum is mounted axially between the primary arms, wherein the carrier drum is mounted to mountings which are different than and seperate from mountings of the primary arms, and wherein the primary arms are independent of the carrier drum.

2. The apparatus of claim 1, wherein the material web is one of a paper web, a board web and a cardboard web.

3. The apparatus of claim 1, wherein the primary arms and the carrier drum move independently from one another.

4. The apparatus of claim 1, wherein the carrier drum is adapted to be coupled to an associated drive in a region of a drive-side carrier drum journal.

5. The apparatus of claim 1, wherein the carrier drum is coupled to an associated drive in a region of a drive-side carrier drum journal.

6. The apparatus of claim 5, wherein the drive-side drum journal is axially arranged between the carrier drum and the primary arm mounting.

7. The apparatus of claim 1, wherein the primary arms movably guide the spool or the reel during the primary winding phase.

8. The apparatus of claim 1, wherein the primary arms pivot about an axis which is substantially parallel to an axis of the carrier drum.

9. The apparatus of claim 1, wherein the primary arms comprise first and second primary arms which are mounted via first and second primary arm mountings to first and second supports.

10. The apparatus of claim 9, wherein the carrier drum is mounted to the first and second supports via first and second carrier drum mountings.

11. The apparatus of claim 10, wherein a first end of the carrier drum is spaced from the first primary arm and wherein a second end of the carrier drum is spaced from the second primary arm.

12. The apparatus of claim 10, wherein the first carrier drum mounting is spaced from the first primary arm and wherein the second carrier drum mounting is spaced from the second primary arm.

13. The apparatus of claim 1, wherein the carrier drum is coupled to an associated drive in a region of a drive-side carrier drum journal, and wherein the apparatus further comprises a drive flange coupled to the drive-side carrier drum journal.

14. The apparatus of claim 13, wherein the drive flange is axially arranged between one end of the carrier drum and a primary arm mounting of one of the primary arms.

15. The apparatus of claim 1, further comprising at least one bearing bracket arranged on drive side of the apparatus, wherein the at least one bearing bracket is coupled to one of the primary arms.

16. The apparatus of claim 15, wherein the at least one bearing bracket comprises an opening for a drive shaft.

17. The apparatus of claim 1, further comprising a measuring device.

18. The apparatus of claim 17, wherein the measuring device is arranged in a region of a carrier drum bearing.

19. The apparatus of claim 17, wherein the measuring device is structured and arranged to measure line forces acting on the carrier drum.

20. The apparatus of claim 17, wherein the measuring device is arranged on a carrier drum bearing.

21. The apparatus of claim 17, wherein the measuring device is coupled to a carrier drum bearing.

22. The apparatus of claim 1, further comprising at least one carrier drum bearing.

23. The apparatus of claim 22, wherein the at least one carrier drum bearing is movably mounted.

24. An apparatus for winding a material web, the apparatus comprising:

one of a spool and a reel;

a carrier drum forming a winding nip with the spool or the reel, wherein the material web is guided over the carrier drum primary arms guiding the spool or the reel when the spool or the reel is in a primary winding phase;

pressing levers arranged on the primary arms, wherein the pressing levers are structured and arranged to press the spool or the reel onto the carrier drum;

secondary arms structured and arranged to press the spool or the reel onto the carrier drum when the spool or the reel is in a secondary winding phase;

at least one carrier drum bearing;

the carrier drum being mounted axially between the primary arms;

the primary arms being independent of the carrier drum; and the at least one carrier drum bearing being movably mounted, wherein the at least one carrier drum bearing is movable along at least one of a linear direction and a generally horizontal direction.

25. The apparatus of claim 23, wherein the at least one carrier drum bearing is movable along a direction that is substantially perpendicular to an axis running through the carrier drum.

26. The apparatus of claim 1, further comprising two carrier drum bearings which are movable along a direction that is substantially perpendicular to an axis running through the carrier drum.

27. The apparatus of claim 1, further comprising two carrier drum bearings supporting the carrier drum, wherein the carrier drum is rotatably mounted to the two carrier drum bearings, wherein the two carrier drum bearings are movable along a direction that is substantially perpendicular to an axis running through the carrier drum, and wherein two carrier drum bearings are mounted between the primary arms.

28. The apparatus of claim 1, further comprising two carrier drum supports, wherein the carrier drum is rotatably mounted to the two carrier drum supports, wherein the two carrier drum supports are movable along a direction that is substantially perpendicular to an axis running through the carrier drum, and wherein two carrier drum supports are arranged between the primary arms.

29. The apparatus of claim 1, further comprising a measuring device structured and arranged to measure line forces along a direction.

30. The apparatus of claim 29, wherein the direction comprises a generally horizontal direction.

31. The apparatus of claim 1, further comprising a measuring device and a positioning device.

32. The apparatus of claim 31, wherein the carrier drum is structured and arranged to produce an axial oscillation of the material web.

33. The apparatus of claim 1, wherein the apparatus is structured and arranged to produce an axial oscillation of the material web on the spool or the reel.

34. An apparatus for winding a material web, the apparatus comprising:

one of a spool and a reel;

a carrier drum forming a winding nip with the spool or the reel, wherein the material web is guided over the carrier drum;

primary arms guiding the spool or the reel when the spool or the reel is in a primary winding phase;

pressing levers arranged on the primary arms, wherein the pressing levers are structured and arranged to press the spool or the reel onto the carrier drum; and secondary arms structured and arranged to press the spool or the reel onto the carrier drum when the spool or the reel is in a secondary winding phase, wherein the carrier drum is mounted axially between the primary arms, wherein the primary arms are independent of the carrier drum, and herein the carrier drum is linearly movably mounted to bearing supports and wherein the apparatus is structured and arranged to allow the material web to be fed to the carrier drum in a direction which is substantially perpendicular to a linear movement direction of the carrier drum.

35. The apparatus of claim 1, wherein the apparatus is structured and arranged to feed the material web from a vertical direction to the carrier drum.

36. The apparatus of claim 1, wherein the carrier drum is mounted to at least one carrier drum bearing and further comprising a doctor mounting arranged on a base of the at least one carrier drum bearing.

37. The apparatus of claim 1, further comprising a spreader roll arranged upstream of the carrier drum in a web running direction, whereby the material web is guided over the spreader roll.

38. The apparatus of claim 37, wherein the spreader roll comprises an elastic covered spreader roll requiring no adjustment and no drive or internal bearings.

39. The apparatus of claim 38, wherein the spreader roll participates in web tension measurement.

40. The apparatus of claim 1, wherein the carrier drum is mounted to CARB bearings.

41. The apparatus of claim 1, wherein the apparatus is structured and arranged to guide the spool or the reel horizontally in the secondary winding phase.

42. The apparatus of claim 1, further comprising at least one of a control device, an evaluation device, and a control/evaluation device.

43. The apparatus of claim 1, wherein the apparatus is structured and arranged to start winding of the spool or the reel at an angled position relative to a vertical line running through an axis of the carrier drum.

44. The apparatus of claim 1, wherein the angled position comprises an angle of approximately 20°.

45. The apparatus of claim 1, wherein, in the primary winding phase, the apparatus is structured and arranged to perform indirect line force control.

46. The apparatus of claim 1, wherein, in the primary winding phase, the apparatus is structured and arranged to perform indirect line force control with pressure predefinition.

47. The apparatus of claim 1, wherein the primary arms pivot about an axis and guide the spool or the reel to a position wherein the spool or the reel can be wound in the secondary winding phase.

48. The apparatus of claim 1, wherein the primary arms pivot about an axis and guide the spool or the reel to a horizontal position wherein the spool or the reel can be wound in the secondary winding phase.

49. The apparatus of claim 1, wherein the primary arms pivot about an axis and guide the spool or the reel onto horizontal rails wherein the spool or the reel can be wound in the secondary winding phase.

50. The apparatus of claim 1, wherein the apparatus is structured and arranged to control a line force while guiding the spool and the reel.

51. The apparatus of claim 50, wherein the line force is indirectly controlled when the spool or the reel is in one position and directly controlled when the spool or the reel is in another position.

52. The apparatus of claim 50, wherein the line force is indirectly controlled when the spool or the reel is in the primary winding phase and directly controlled when the spool or the reel is in the secondary winding phase.

53. The apparatus of claim 1, further comprising primary pressing elements adapted to be driven based on measured values of a measuring device.

54. The apparatus of claim 1, further comprising primary pressing elements coupled to the pressing levers, wherein the primary pressing elements are moved based on measured values of a measuring device.

55. The apparatus of claim 1, further comprising primary pressing elements moving the pressing levers, wherein the primary pressing elements move the pressing levers based on measured values of a measuring device.

56. The apparatus of claim 1, further comprising a device for monitoring primary pressing elements coupled to the pressing levers.

57. The apparatus of claim 56, further comprising one of a control device and an evaluation device for conducting a fault diagnosis.

58. The apparatus of claim 1, wherein the spool or the reel is structured and arranged to move from the primary winding phase to a transition phase and then to the secondary transition phase.

59. The apparatus of claim 58, wherein the apparatus is structured and arranged to provide at least a substantially constant line force profile in the transition phase.

60. The apparatus of claim 58, wherein the pressing levers are structured and arranged to press the spool or the reel against the carrier drum so as to provide at least a substantially constant line force profile in the transition phase.

61. The apparatus of claim 1, wherein the apparatus is structured and arranged to provide direct line force control in the secondary winding phase.

62. The apparatus of claim 1, further comprising a device for monitoring secondary pressing elements.

63. The apparatus of claim 62, wherein the secondary pressing elements are coupled to the secondary arms.

64. The apparatus of claim 62, wherein the secondary pressing elements move the secondary arms and press the spool or the reel against the carrier drum in the secondary winding phase.

65. The apparatus of claim 62, further comprising one of a control device and an evaluation device for conducting a fault diagnosis.

66. The apparatus of claim 1, wherein the apparatus is structured and arranged to receive a new spool.

67. The apparatus of claim 66, wherein the apparatus is structured and arranged to maintain a substantially constant hydraulic pressure in a secondary pressing system based on a measuring device and before the new spool is received on the apparatus.

68. The apparatus of claim 1, wherein the apparatus is structured and arranged to at least one of control and regulate a line force.

69. The apparatus of claim 1, wherein the apparatus is structured and arranged to transition from direct line force control to indirect line force control.

70. The apparatus of claim 1, further comprising one of a control device and an evaluation device structured and arranged to begin a new control cycle after a full spool has been ejected from the apparatus.

71. An apparatus for winding a material web, the apparatus comprising:

a carrier drum configured to form a winding nip with a spool;

the carrier drum being rotatably mounted to first and second mounting devices;

first and second primary arms configured to move the spool over the carrier drum from a primary winding position to a secondary winding position;

first and second pressing levers respectively pivotally mounted to the first and second primary arms;

the first and second pressing levers being structured and arranged to press the spool against the carrier drum; and secondary arms structured and arranged to press the spool against the carrier drum when the spool is in a secondary winding position, wherein the carrier drum is mounted between the first and second primary arms, and wherein the carrier drum is mounted to mountings which are different than and seperate from mountings of the first and second primary arms.

72. The apparatus of claim 71, further comprising a force measuring device configured to detect a force applied to the carrier drum by the spool in at least one of the primary and secondary winding positions.

73. An apparatus for winding a material web, the apparatus comprising:

a carrier drum configured to form a winding nip with a spool;

the carrier drum being rotatably mounted to first and second mounting devices;

first and second primary arms configured to move the spool over the carrier drum from a primary winding position to a secondary winding position;

first and second pressing levers respectively pivotally mounted to the first and second primary arms;

the first and second pressing levers being structured and arranged to press the spool against the carrier drum; and secondary arms structured and arranged to press the spool against the carrier drum when the spool is in a secondary winding position, wherein the carrier drum is mounted between the first and second primary arms, and wherein the first and second mounting devices are movable along at least one of a linear direction and a horizontal direction.

74. The apparatus of claim 73, further comprising a measuring device configured to detect a force applied to the carrier drum by the spool in at least one of the primary and secondary winding positions.

75. A method of winding a material web, the method comprising:

placing a spool into a primary winding position of an apparatus comprising a carrier drum arranged between first and secondary primary arms, wherein the carrier drum is configured to form a winding nip with the spool, and wherein the carrier drum is mounted to mountings which are different than and seperate from mountings of the first and second primary arms;

rotating the carrier drum and the spool to wind the spool in the primary winding position;

pressing the spool against the carrier drum in the primary winding position with first and second pressing levers respectively pivotally mounted to the first and second primary arms;

moving the spool with first and second primary arms over the carrier drum from the primary winding position to a secondary winding position;

pressing the spool against the carrier drum when the spool is in the secondary winding position; and moving the spool away from the secondary winding position after the spool is fully wound.

76. The method of claim 75, further comprising measuring a force applied to the carrier drum in at least one of the primary and secondary winding positions.

77. A method of winding a material web, the method comprising:

placing a spool into a primary winding position of an apparatus comprising a carrier drum arranged between first and secondary primary arms, wherein the carrier drum is configured to form a winding nip with the spool;

rotating the carrier drum and the spool to wind the spool in the primary winding position;

pressing the spool against the carrier drum in the primary winding position with first and second pressing levers respectively pivotally mounted to the first and second primary arms;

moving the spool with first and second primary arms over the carrier drum from the primary winding position to a secondary winding position;

pressing the spool against the carrier drum when the spool is in the secondary winding position;

moving the spool away from the secondary winding position after the spool is fully wound; and moving the carrier drum along at least one of a linear direction and a horizontal direction.

78. A method of winding a material web, the method comprising:

placing a spool into a primary winding position of an apparatus comprising a carrier drum arranged between first and secondary primary arms, wherein the carrier drum is configured to form a winding nip with the spool;

rotating the carrier drum and the spool to wind the spool in the primary winding position;

pressing the spool against the carrier drum in the primary winding position with first and second pressing levers respectively pivotally mounted to the first and second primary arms;

moving the carrier drum along at least one of a linear direction and a horizontal direction while the spool is in the primary winding position;

moving the spool with first and second primary arms over the carrier drum from the primary winding position to a secondary winding position;

pressing the spool against the carrier drum when the spool is in the secondary winding position; and moving the spool away from the secondary winding position after the spool is fully wound.

79. A method of winding a material web, the method comprising:

placing a spool into a primary winding position of an apparatus comprising a carrier drum arranged between first and secondary primary arms, wherein the carrier drum is configured to form a winding nip with the spool;

rotating the carrier drum and the spool to wind the spool in the primary winding position;

pressing the spool against the carrier drum in the primary winding position with first and second pressing levers respectively pivotally mounted to the first and second primary arms;

moving the spool with first and second primary arms over the carrier drum from the primary winding position to a secondary winding position;

pressing the spool against the carrier drum when the spool is in the secondary winding position;

moving the carrier drum along at least one of a linear direction and a horizontal direction while the spool is in the secondary winding position; and moving the spool away from the secondary winding position after the spool is fully wound.

80. The method of claim 75, further comprising controlling a line force between the carrier drum and the spool while the spool is in the primary winding position.

81. The method of claim 75, further comprising controlling a line force between the carrier drum and the spool while the spool is in the secondary winding position.

82. The method of claim 75, further comprising detecting with a measuring device a force applied to the carrier drum by the spool in at least one of the primary and secondary winding position.

* * * * *